United States Patent [19]

Bier

[11] Patent Number: 4,804,139

[45] Date of Patent: Feb. 14, 1989

[54] COOLING SYSTEM FOR A WATER-COOLED VEHICLE ENGINE

[75] Inventor: Axel Bier, Gundelsheimn, Fed. Rep. of Germany

[73] Assignee: Audi AG, Fed. Rep. of Germany

[21] Appl. No.: 118,401

[22] Filed: Nov. 9, 1987

[30] Foreign Application Priority Data

Nov. 8, 1986 [DE] Fed. Rep. of Germany ..... 3638131

[51] Int. Cl.[4] ..... F01P 5/14

[52] U.S. Cl. ..... 236/35; 236/78 B; 123/41.15

[58] Field of Search ..... 236/35, 94, 35.2, 35, 236/3, 78 B; 62/133; 123/41.15, 41.05; 165/39

[56] References Cited

U.S. PATENT DOCUMENTS 4,425,766 1/1984 Claypole ..... 236/35 X 4,556,029 12/1985 Yamaguchi et al. ..... 123/41.15

*Primary Examiner*—William E. Wayner

*Attorney, Agent, or Firm*—Kane, Dalsimer, Sullivan, Kurucz, Levy, Eisele and Richard

[57] ABSTRACT

A cooling system for a water-cooled vehicle engine has a radiator through which cooling water flows and which can be exposed to cooling air by an electric fan (9). A first heat sensor (F1) on the engine block senses the water outflow temperature, while a second heat sensor (F2) senses the radiator outflow temperature. The sensed values from both sensors are fed to an electronic control unit (11) which also stores temperature threshold values for both sensor, at which certain functions have to be performed. In the event of failure of either sensor, the electronic control unit (11) takes over the function of the sensor: from the temperature value sensed by the other sensor a temperature equivalent value is formed by adding or subtracting the temperature difference which exists between the two sensors at running temperature. The control unit then activates the appropriate function if the relevant threshold value is reached or exceeded.

11 Claims, 3 Drawing Sheets

COOLING SYSTEM FOR A WATER-COOLED VEHICLE ENGINE

Figure 1:
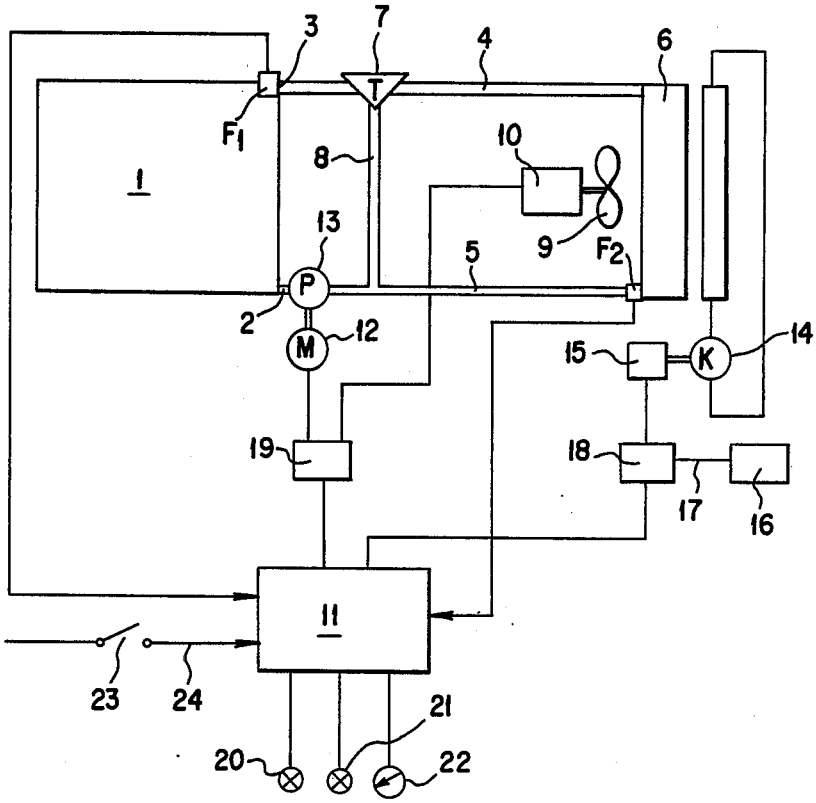

This invention relates to a cooling system for a water-cooled vehicle engine, of the type comprising a liquid coolant radiator, an electrically driven fan for impelling cooling air across the radiator, a first heat sensor on or adjacent the engine block, and arranged to trigger certain functions or alarms when a selected water outlet temperature is reached or exceeded, and a second heat sensor at or adjacent the outlet from the radiator, and arranged to switch on the fan motor when a selected radiator outlet temperature is reached or exceeded.

In known cooling systems of this general type, if one of the two heat sensors fails, either the cooling air fan is not switched on or the alarm is not triggered, depending upon which of the two heat sensors has failed. The result of the cooling air fan not being switched on is that the cooling water temperature may rise to a value at which the first heat sensor triggers an alarm which signals the necessity for the engine to come to a standstill in order to prevent a breakdown. But if the first sensor fails (that which is intended to trigger the alarm) there is a danger of the engine being damaged or destroyed. This can naturally also be the case both sensors fail.

The problem underlying the invention is to provide a cooling system of the general type referred to, in which the greatest possible safety for the engine is provided in the event of failure of one or both heat sensors.

The invention consists in a cooling system for a water cooled vehicle engine of the type referred to above including an electric control unit, in which values dependent on selected temperatures of the two heat sensors are stored, and the said functions are executed when the selected temperature(s) is (are) reached, the control unit being arranged to receive the sensed temperature values from both heat sensors, and in the event of failure of one sensor, to take over the function of this sensor by creating a temperature equivalent value by adding to or subtracting from the temperature determined by the other sensor the difference in temperature between the two sensors established at running temperature, so as to execute the relevant functions when the defined temperature(s) of the failed sensor has (have) been reached or exceeded.

In a preferred arrangement, the electronic control unit, in the event of failure of one heat sensor, takes over the function of this sensor, taking account of the difference between the temperatures sensed by the two heat sensors which exists in normal running, so that the function which has to be triggered at a selected temperature of the failed heat sensor is actually triggered at essentially the same temperature.

In a possible development of this inventive concept, the experimentally ascertained difference in temperature between the two heat sensors can be modified in dependence upon the engine speed and/or the vehicle driving speed; this allows the control unit also to take account of the cooling water throughput (which is dependent on engine speed) or cooling air throughput (which is dependent on vehicle speed).

In a known cooling system, an alarm which signals that the engine must come to a standstill is triggered by the first heat sensor if the cooling water outflow temperature from the engine has reached or exceeded a certain value. To ensure that such an alarm is triggered only in the event of exceptional emergency, the electronic control unit of the present invention is preferably arranged that when a selected temperature of the first heat sensor is reached, it switches on the fan motor before the alarm is triggered; this provides that in the event the fan has not yet been switched on, all possibilities for cooling are exhausted before the alarm is triggered. If the vehicle has an air conditioning system with a compressor, the air conditioning compressor is also preferably switched off and the loading on the engine thereby reduced, before the alarm is triggered and the alarm signal is triggered only if the critical temperature threshold is reached or exceeded in spite of this reduction in the load.

The electronic control unit preferably includes an emergency running function arranged to switch on the fan motor at the maximum possible speed in the event of both heat sensors failing. At the same time, a warning light is activated, the air conditioning compressor is switched off, and a temperature display is set at a maximum value.

In a known cooling system the control and display device functions only when the engine is running, i.e. when the ignition is switched on. It is however desirable or necessary that the cooling air fan should continue to run after the engine has been shut down following heavy stress or load, and the system includes a further engine temperature sensor with a timer device which keeps the fan motor running for a certain time after the engine has been switched off. In the present invention however this third heat sensor can be omitted because the electronic control device is constantly (i.e. permanently or semi-permanently) switched on and includes a timer device or element which reacts to the switching-off of the ignition and keeps the fan motor switched on for a certain period of time if the temperature sensed by the first heat sensor exceeds a selected value. The cooling of the engine after switching-off can be speeded up by an auxiliary electrical water pump arranged in the cooling circuit of the engine which is switched on by the aforementioned timer element of the electrical control unit or by an individual timer element. By this means, heat is rapidly extracted from the engine.

Figure 2A:
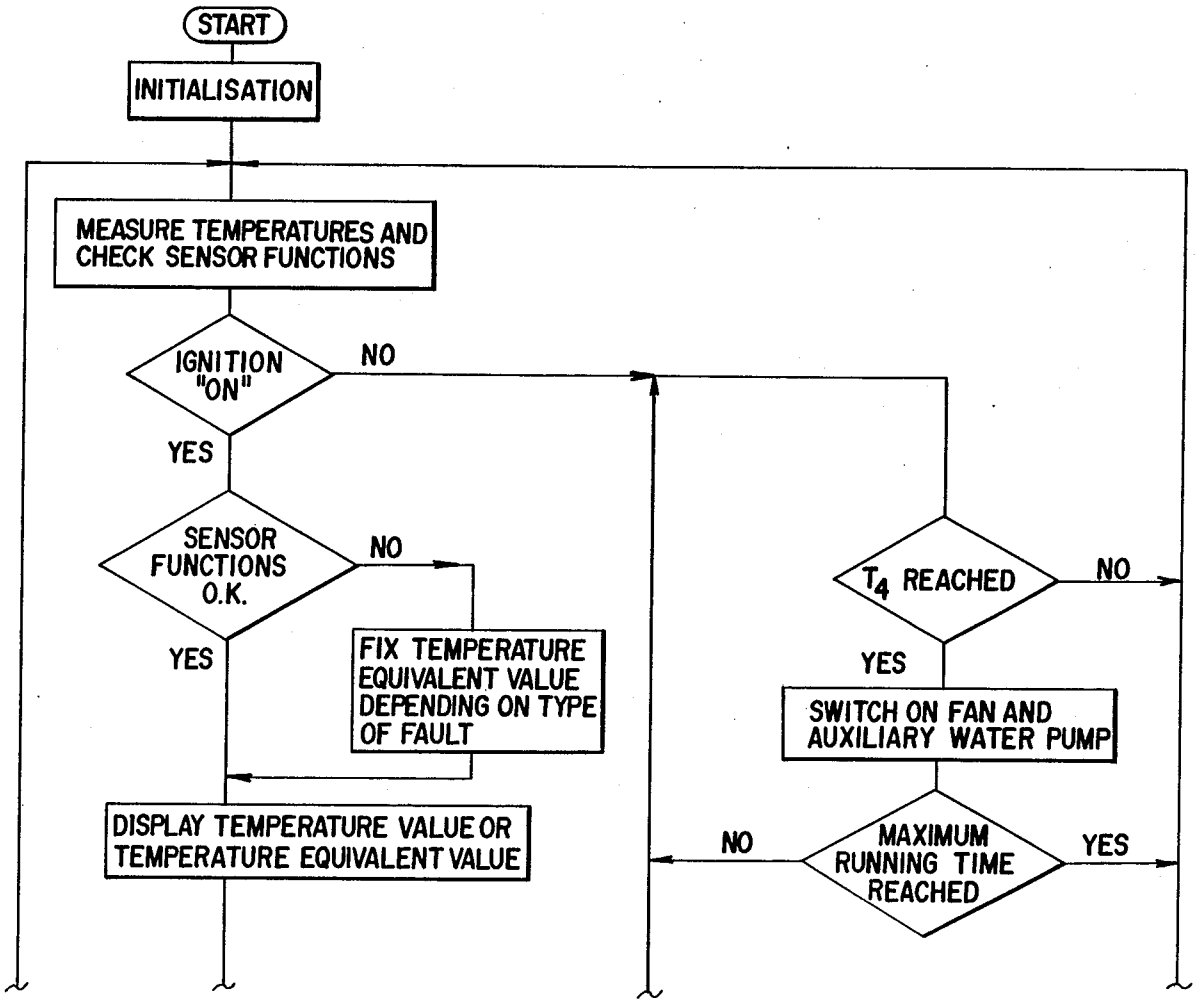
Figure 2B:
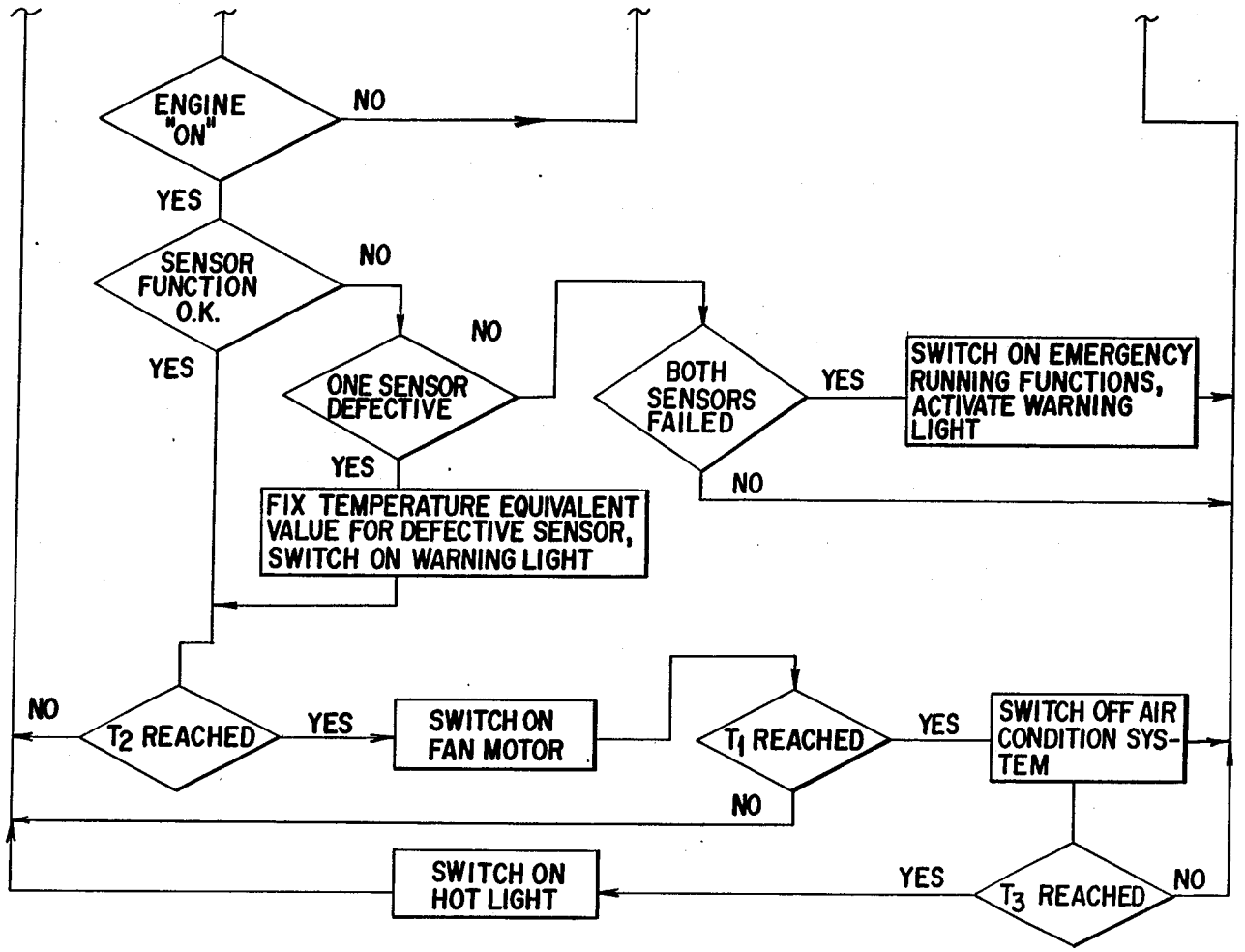

The invention may be performed in various ways and one specific embodiment with some possible modifications will now be described by way of example with reference to the accompanying drawings, in which:

FIG. 1 is a diagrammatic illustration of a cooling circuit according to the invention, for a vehicle engine with an air conditioning compressor, FIG. 2 is a flow chart showing the sequence of operations of the electronic control device of FIG. 1.

In the example illustrated in FIG. 1 a vehicle engine 1 has a cooling water jacket with a cooling water inlet port 2 and a cooling water exit port 3 which are connected respectively via ducts 4 and 5 to a radiator 6. A by-pass duct 8 controlled by a thermostatic valve 7 by-passes the radiator 6, as long as the engine temperature has not reached a certain selected value. The cooling medium is circulated by a fluid pump (not shown) driven by the engine 1. A cooling air fan 9, driven by an electric motor 10, is arranged to draw cooling air through the radiator.

On the engine block of the engine 1 is positioned a first heat sensor F1, arranged to sense the water outlet temperature from the block. A second heat sensor F2 is positioned at the water exit from the radiator 6, to sense the radiator outlet temperature. The signals of the two heat sensors F1 and F2 are fed to an electronic control unit 11, in which temperature threshold or limit values are stored for both heat sensors, at which certain functions have to be executed. The sequence of operations can be seen from the flow chart of FIG. 2 and is described later on. In the cooling water return line 5 is arranged an auxiliary pump 13 driven by an electric motor 12, whose function is described later on.

In the illustrated example it is assumed that the vehicle is provided with an air conditioning system including an air conditioning compressor 14, driven by the engine 1 via a disconnectable electromagnetic coupling 15. The control system for the air conditioning system is indicated at 16, from which a control line 17 is connected to a relay 18, which can be influenced by the electronic control unit 11 as will be described below.

A relay 19 actuated by the control 11 is positioned in a control line between the control unit 11 and the fan and water pump motors 10 and 12. In addition the control unit 11 also actuates a "hot light" 20, a warning light 21 (fault display) and a temperature display 22.

Furthermore the control unit 11 is also connected via line 24 to an ignition switch 23, so as to receive signals indicating whether the ignition switch 23 is open or closed.

If the temperature at the output of the radiator 6 reaches or exceeds a selected value T2, the fan motor 10 is switched on by the electronic control unit 11, either in stages or progressively, depending upon the temperature. A temperature reading is produced simultaneously on the instrument 22.

If the heat sensor F1 detects an engine water outflow temperature which is equal to or higher than a predetermined threshold value T1, the control unit 11 causes the fan motor to rotate at the maximum possible speed. If a slightly higher temperature threshold value is exceeded, the relay 18 is then activated by the control unit 11 to disconnect the air conditioning compressor 14 and thereby reduce the load on the engine 1. If in spite of these two measures, the temperature at the first heat sensor F1 reaches or exceeds a value T3, the "hot light" 20 is activated by the control unit 11, which indicates to the driver that the engine 1 must be promptly brought to a standstill in order to prevent a breakdown.

The electronic control unit 11 is so constructed and arranged that in the event of failure of either heat sensor F1 or F2, it takes over the function of the failed heat sensor, since an equivalent temperature value is formed which corresponds completely or approximately to the actual temperature at the point where the sensor has failed. This temperature equivalent value is determined by ascertaining the temperature difference existing in normal running between the temperatures sensed by the two sensors and either deducting this from, or adding it to the temperature which has been sensed by the sensor which has not failed. Thus if the sensor F1 fails, the temperature sensed by the sensor F2 has added to it the temperature difference which exists in normal running, and if the total of these values reaches or exceeds the predetermined values T1 or T3, all functions are triggered by the control appliance 11 in the same way as would be the case if the heat sensor F1 has ascertained a temperature value T1 (or T3). Conversely, if the heat sensor F2 fails, the aforementioned temperature difference is deducted from the temperature value sensed by the heat sensor F1, and if the resulting temperature value is equal to or higher than the temperature T2, the fan motor 10 is again switched on by the control unit 11 in the way described above. Generally, it will be sufficient to ascertain the temperature difference between the two sensors F1 and F2 as a correction factor for the creation of the temperature equivalent value when the engine is warmed up. It is, however, basically possible to vary this correction factor in dependence on engine speed ne and/or driving speed nv, in order to take account of the water throughput (which is dependent on engine speed)and/or the cooling air throughput (which is dependent on driving speed) and so achieve an even more accurate control.

If one of the two heat sensors F1 or F2 fails, the warning light is also activated by the control unit 11.

The electronic control unit 11 is so programmed, that in the event of failure of both heat sensors F1 and F2, the fan motor 10 is switched to maximum speed, the air conditioning compressor 14 is switched off via the relay 18, the temperature display 22 is brought to the maximum and the warning light 21 is switched on at the same time.

The aforementioned faults, that is to say the failure of one or both heat sensors F1 and F2, are stored in a memory in the electronic control unit 11 so that it is possible to determine the fault rapidly in the workshop.

The electronic control unit is permanently switched on, and is therefore not switched off when the engine 1 is switched off. As a result, there is a possibility of making the cooling air fan motor 10 run on with the heat sensor F1. For this purpose, there is provided in the control unit 11 a timer device which is activated after the-motor (engine) 1 is switched off and switches on the fan motor 10, or leaves it switched on for a selected interval, if the heat sensor F1 has detected a certain temperature. The electrically driven pump 13 is provided to speed up the extraction of heat from the engine 1, the electric motor 12 for the pump being switched on by the timer device activating the relay 19. An auxiliary timer device may be provided, and arranged to be activated each time the engine 1 is switched off, and to switch on the pump motor 12 for several seconds in order to prevent corrosion of the pump 13 which might occur during a prolonged standstill.

The sequence of operations of the electronic control unit 11 is illustrated in FIG. 2. In this flow chart $T_1$ is the selected temperature threshold for the sensor $F_1$, at which the air conditioning system is switched off, $T_2$ is the selected temperature threshold for the sensor $F_2$, for switching on the fan motor 10, $T_3$ is the selected temperature threshold for the sensor $F_1$ for switching on the "hot light" 20, and $T_4$ is the selected temperature threshold for the sensor $F_1$ for the activation of the timer device for switching on the fan motor 12 after the engine has been switched off.

I claim:

1. A cooling system for a water-cooled vehicle engine, including a liquid coolant radiator, an electrically driven fan for impelling cooling air across the radiator, a first heat sensor on or adjustment the engine block, and arranged to trigger certain functions or alarms when a selected water outlet temperature is reached or exceeded, a second heat sensor at or adjacent the outlet from the radiator, and arranged to switch on the fan motor when a selected radiator outlet temperature is reached or exceeded, and an electronic control unit, in which values dependent on selected temperatures of the two heat sensors are stored, and the said functions are executed when the selected temperature(s) is (are) reached, the control unit being arranged to receive the sensed temperature values from both heat sensors, and in the event of failure of one sensor, to take over the function of this sensor by creating a temperature equivalent value by adding to or substracting from the temperature determined by the other sensor the difference in temperature between the two sensors established at running temperature, so as to execute the relevant function(s) when the defined temperature(s) of the failed sensor has (have) been reached or exceeded.

2. A cooling system as claimed in claim 1, including means for modifying the temperature difference value in accordance with the speed of the engine.

3. A cooling system as claimed in claim 1 in which the electronic control unit is so constituted that when the temperature of the first heat sensor reaches the selected threshold it switches on the fan motor before it triggers an alarm.

4. A cooling system as claimed in claim 3, for a vehicle engine which drives a compressor of an air conditioning system, in which the electronic control unit is so arranged that when the temperature of the first heat sensor reaches a selected value in spite of the fan motor being switched on it switches off the compressor.

5. A cooling system as claimed in any one of claims 1 to 4, in which the electronic control unit is so arranged that in the event of failure of both heat sensors it switches on the fan motor, switches off the air conditioning compressor, activates a fault display, and sets a water temperature display (if present) at a maximum reading.

6. A cooling system as claimed in which the electronic control unit is permanently switched on, and includes a timer device which reacts to the switching-off of the engine ignition and which sustains the power to the fan motor if the temperature established by the first heat sensor exceeds a certain value.

7. A cooling system as claimed in claim 5, in which the electronic control unit is permanently switched on, and includes a timer device which reacts to the switching-off of the engine ignition and which sustains the power to the fan motor if the temperature established by the first heat sensor exceed a certain value.

8. A cooling system as claimed in anyone of claims 6, or 7 in which the cooling circuit of the engine includes an auxiliary electric water pump which is switched on by the timer device of the electrical control unit which sustains the power to the fan motor by an individual timer element which is activated when the engine is shut off.

9. A cooling system as claimed in claim 1, including means for modifying the temperature difference value in accordance with the driving speed of the vehicle.

10. A cooling system as claimed in claim 3, in which the electronic control unit is permanently switched on, and includes a timer device which reacts to the switching-off of the engine ignition and which sustains the power to the fan motor if the temperature established by the first heat sensor exceeds a certain value.

11. A cooling system as claimed in claim 6 in which the cooling circuit of the engine includes an auxiliary electric water pump which is switched on by the timer device of the electrical control unit which sustains the power to the fan motor by an individual timer element which is activated when the engine is shut off.

* * * * *